US011396106B2

(12) United States Patent
Yang et al.

(10) Patent No.: US 11,396,106 B2
(45) Date of Patent: Jul. 26, 2022

(54) HAIR CUTTING DEVICE ADAPTED FOR CUTTING ONE'S OWN HAIR

(71) Applicants: Hsu Kai Yang, Pleasanton, CA (US); Luke Tzenmin Luangrath, Highland, UT (US); Jerin Tzenjie Luangrath, Highland, UT (US)

(72) Inventors: Hsu Kai Yang, Pleasanton, CA (US); Luke Tzenmin Luangrath, Highland, UT (US); Jerin Tzenjie Luangrath, Highland, UT (US)

( * ) Notice: Subject to any disclaimer, the term of this patent is extended or adjusted under 35 U.S.C. 154(b) by 0 days.

(21) Appl. No.: 17/399,653

(22) Filed: Aug. 11, 2021

(65) Prior Publication Data

US 2022/0134585 A1 May 5, 2022

Related U.S. Application Data

(60) Provisional application No. 63/107,162, filed on Oct. 29, 2020.

(51) Int. Cl.

| | |
|---|---|
| ***B26B 19/04*** | (2006.01) |
| ***B26B 19/20*** | (2006.01) |
| ***A45D 24/36*** | (2006.01) |
| ***A45D 24/10*** | (2006.01) |
| ***B26B 19/38*** | (2006.01) |
| *B26B 29/04* | (2006.01) |

(52) U.S. Cl.

CPC ..... *B26B 19/04* (2013.01); *A45D 24/10* (2013.01); *A45D 24/36* (2013.01); *B26B 19/20* (2013.01); *B26B 19/388* (2013.01); *B26B 29/04* (2013.01)

(58) Field of Classification Search

CPC ..... B26B 19/04; B26B 19/20; B26B 19/388; A45D 24/10; A45D 24/36

USPC ..... 30/200–202

See application file for complete search history.

(56) References Cited

U.S. PATENT DOCUMENTS

| | | | | |
|---|---|---|---|---|
| 2,593,168 | A * | 4/1952 | Monyhan | B26B 19/20 30/201 |
| 3,237,304 | A * | 3/1966 | Merzon | B26B 19/20 30/201 |
| 10,307,921 | B2 | 6/2019 | Krenik | |
| 10,357,092 | B2 | 7/2019 | Kustra | |
| 10,820,679 | B1 | 11/2020 | Aossey | |
| 2013/0263457 | A1* | 10/2013 | Sobagaki | B26B 19/20 30/201 |
| 2015/0059187 | A1* | 3/2015 | Krenik | B26B 19/42 30/123 |
| 2016/0257009 | A1* | 9/2016 | Godlieb | B26B 19/388 |

* cited by examiner

*Primary Examiner* — Kenneth E Peterson
*Assistant Examiner* — Nhat Chieu Q Do
(74) *Attorney, Agent, or Firm* — Kunzler Bean & Adamson, PC

(57) ABSTRACT

A hair cutting device adapted for cutting one's own hair comprises a comb piece having teeth with smooth comb edges near open ends and sharp cutting edges near closed ends, a moving cutting arm with sharp cutting teeth in contact and rough alignment with the sharp cutting edges of the comb piece, capable of reciprocating sideways back and forth and cutting hair in conjunction with the sharp cutting edges of the comb piece, and a hair guard in close proximity along their lengths. The hair guard can be lowered to expose the sharp cutting edges of the comb piece and moving cutting arm to cut hair or raised above the sharp cutting edges to work as a comb.

5 Claims, 3 Drawing Sheets

5
10
10a
10b
11
12
12a
13
14
15
16
17
18
19
20
20a
21
21a
22
24
14 R
15 R
16 R

HAIR CUTTING DEVICE ADAPTED FOR CUTTING ONE'S OWN HAIR

CROSS-REFERENCE

This application claims the benefit of provisional patent application No. 63/107,162, filed 2020 Oct. 29 by the present inventors.

BACKGROUND

Prior Art

US Patents

| Pat. No. | Kind Code | Issue Date | Patentee |
|---|---|---|---|
| 10,820,679 | B1 | Nov. 3, 2020 | Aossey |
| 10,357,092 | B2 | Jul. 23, 2019 | Kustra |
| 10,307,921 | B2 | Jun. 4, 2019 | Krenik |

Cutting hair for someone else involves two hands working together. Usually one hand uses a comb as a guide to determine the part of hair to be cut. The other hand holds a cutting device, a pair of scissors or a hair clipper, to cut off the part of hair guided by the comb. It is almost impossible to cut one's own hair with both hands behind or on the sides of one's head. Using a mirror to guide and properly cut one's own hair adds another level of difficulty due to the disorientation inherent to using mirror image. For these reasons, there is no simple hair cutting device that can be used for cutting one's own hair. This invention teaches a simple and easy to use device to achieve this function—cutting one's own hair.

The prior art cited here for the purpose of cutting one's own hair are either inadequate or impractical. The U.S. Pat. No. 10,820,679 (2020) issued to Aossey is a mere guiding device hanging around the one's ears to provide even lines for cutting devices. The U.S. Pat. No. 10,357,092 (2019) issued to Kustra and U.S. Pat. No. 10,307,921 (2019) to Krenik are very costly and elaborate devices requiring sensors, computing or decision making machines and intelligent hair cutting devices. Even if they can be made cost effective for average consumers; the learning process needed for average users to attain proficiency will make them impractical.

SUMMARY

This invention combines the comb and cutting device together to form a comb like cutting device. A comb like piece with the top parts of teeth near the open end are smooth like comb teeth. The lower parts of the teeth near the closed end have sharp cutting edges. A hair guard adjacent and along their lengths to the comb like piece can be moved up and down. When the hair guard is up the sharp edges of its teeth are covered, and the comb like piece works just like a comb. The hair will not be caught or snagged by the sharp cutting edges at lower parts of the teeth. When the hair guard is lowered to expose the sharp cutting edges, hair between the sharp edged teeth can be cut off, in conjunction with the sharp edged teeth of a moving cutting arm just like a regular hair clipper. A control and driving unit can lower and raise the hair guard, adjust the spacing between the hair guard and comb like piece and drive the moving cutting arm sideways back and forth. This device effectively reduces hair cutting process to one hand operation.

The control and driving unit further has switches with various functions to cut hair. It can further be controlled by a wireless remote control unit. This wireless remote control unit may include all, or even additional functions than that enabled with switches on the control and driving unit. The wireless remote control is also an important part of this invention for cutting one's own hair. One can use the other hand in any position holding the wireless remote control or using voice only or other means to remotely activate all functions on the control and driving unit. So the hand holding the hair cutting device with control and driving unit can be kept steady to cut off the intended hair, not to be disturbed by the need and motion of touching switches on the control and driving unit.

DRAWINGS

FIG. 1 is the front view of a preferred embodiment of this hair cutting device (5) with the comb like piece (10), moving cutting arm (12), hair guard (11), control and driving unit (13) with function switches and an AC convertor (18)

FIG. 1*a* is an exploded view of a single tooth of the comb like piece (10) showing the smooth edged part (10*a*) and sharp edged part (10*b*)

REFERENCE NUMERALS IN THE FIGURES

Figures 1, 1A, 2, 3, 4, 5:
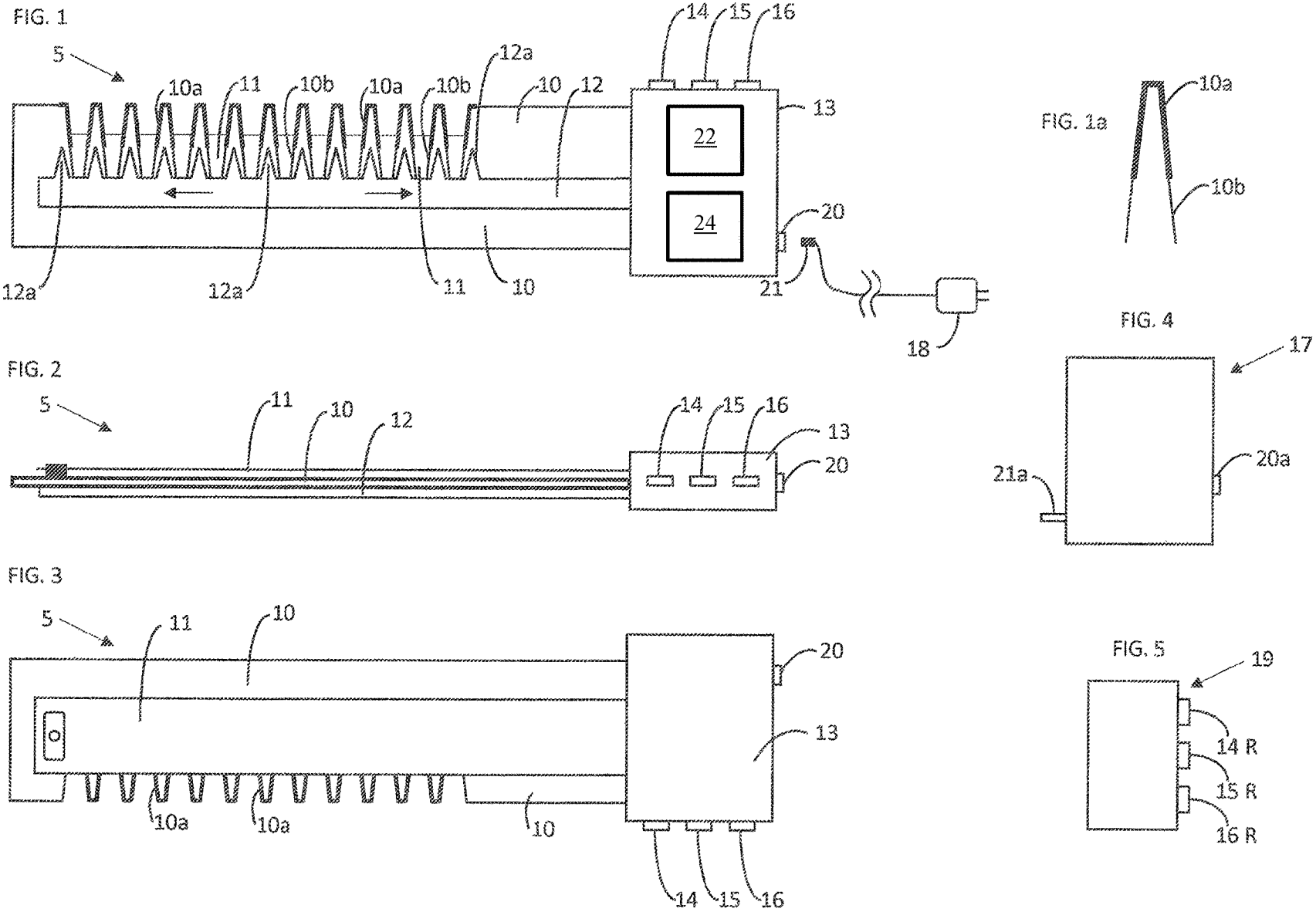
FIG. 2 is the top view of this hair cutting device (5) showing the comb like piece (10) in the middle, the hair guard (11) on one side of the comb like piece (10), moving cutting arm (12) on the other side and control and driving unit (13) on right.
FIG. 3 shows the top side down rear view of this hair cutting device (5), comb like piece (10), hair guard (11) and control and driving unit (13)
FIG. 4 shows a battery pack (17).
FIG. 5 shows a wireless remote control (19) having equivalent function switches on the control and driving units (13).

5. a haircutting device
10. comb like piece
  10*a*. smooth comb like part of the comb tooth.
  10*b*. sharp cutting edge part of the comb tooth.
11. hair guard
12. moving cutting arm
  12*a*. sharp edged cutting tooth on moving cutting arm
  12*b*. driving teeth on moving cutting arm
13. control and driving unit
14. 15. and 16. function switches on control and driving unit (13)
  14R, 15R and 16R equivalent function switches on wireless remote control (19)
17. battery pack
18. AC convertor unit
19. wireless remote control
20. power receptacle on control and driving unit (13)
  20*a* charging receptacle on the battery pack (17)

21. connector jack from AC convertor (18) to receptacle (20) on control and driving unit (13)

21*a*. connector jack from battery pack (17) to receptacle (20) on control and driving unit (13)

40. moving cutting arm cover

50. selective hair guard

60. manual embodiment

61. pivot

62. circular moving piece with driving teeth

63. scissor like arm

65. tap on scissor like arm (63)

DETAILED DESCRIPTION

A preferred embodiment of a hair cutting device (5) in FIG. 1 comprises a comb like piece (10) with the top part near the open ends of its teeth (10*a*) are smooth comb like teeth and bottom part of teeth near the closed ends (10*b*) comprises sharp edges for cutting hair. A moving cutting arm (12) with sharp edged teeth (12*a*) is able to move sideways back and forth. The moving cutting arm (12) is held in close proximity to comb like piece (10). Their sharp teeth are touching to allow hair be cut like a conventional hair clipper. Its sharp teeth tips are roughly in line with the heights of sharp edges of comb like teeth (10*b*). With the sharp teeth edges (10*b*) of the comb like piece (10), they work just like a regular hair clipper able to cut off hair between their sharp edges. The hair guard (11) is in a position above the cutting teeth (10*b*) of comb like piece (10) and cutting teeth (12*a*) of the moving cutting arm (12) when cutting function is not enabled. So this hair cutting device (5) works as comb. When hair cutting functions are enabled, the hair guard (11) will lower itself to expose the sharp edges of teeth (10*b*) of the comb like piece (10) and moving cutting arm teeth (12*a*). The moving cutting arm moves sideways, back and forth. Hair between the cutting teeth will be cut off, like a hair clipper. When hair cutting functions terminate, the hair guard is raised to the original position and moving cutting arm stops. This hair cutting device (5) again works as a comb.

The comb like piece (10), hair guard (11) and moving cutting arm (12) are coupled with the control and driving unit (13). The control and driving unit (13) comprises a motor (13) or motors (13), mechanical gears and connections to lower and raise the hair guard (11) and drive the moving cutting arm (12) sideways back and forth to perform hair cutting functions.

Although it is not shown or not shown in details in the drawings, one with ordinary skill in mechanical design can keep the hair guard (11) in place at the opposite end of the control and driving unit (13) and up and down movements possible. The moving cutting arm (12) can be kept in close proximity with its sharp teeth (12*a*) touching the sharp teeth (10*b*) of comb like piece (10) and able to move sideways back and forth to cut hair like a conventional hair clipper.

This control and driving unit (13) further comprises switches (14, 15, 16), and decision making means (22) to perform various functions or sequences of functions. The decision making means (22) can include, but not limited to, a microprocessor (22) or microprocessors (22). It can include a switch (14) for single or short duration cutting mode and a continuous hair cutting mode switch (15). The single or short duration cutting mode imitates one cut at a time either by a pair of scissors or hair clipper guided by a comb. This mode of cutting hair mitigates serious mistakes of cutting off a patch of un-intended hair. The continuous mode allows faster continuous cutting at places where the hair lengths are less critical or as one's skill improved.

This control and driving unit (13) can further comprise a switch (16) for adjusting the spacing between the hair guard (11) and comb like piece (10) to control the lengths of hair after the cut. This feature can help less experienced users to use the hair guard against one's head to determine the remaining hair length after the cut.

This control and driving unit (13) can further comprise a wireless receiver (24) that will receive control signals from a wireless remote control (19) which is described below. Additional functions can be added to control the movements or sequences of movements of hair guard (11) and moving cutting arm (12).

An AC convertor (18) with a power connector jack (21) can be plugged into a power receptacle (20) on the control and driving unit (13) to provide power for the hair cutting device (5).

In another embodiment, a battery pack (17) can be used instead of AC convertor (18). This battery pack has a power connector jack (21*a*) that can be plugged into the power receptacle (20) on the control and driving unit (13) to provide power and making this hair cutting device cordless. This battery pack can be charged by the AC convertor (18) through the power receptacle (20*a*). Alternatively, a charging base may be employed to charge the battery pack through physical or wireless (i.e. inductive) charging.

In another embodiment, the control and driving unit (13) can communicate with a wireless remote control (19) in FIG. 5. The wireless remote control (19) can have all or additional function switches and operational modes than the switches on the control and driving unit (13). The switches 14R, 15R and 16R on the wireless remote control (19) can be equivalent function switches of 14, 15 and 16 on the control and driving unit (13). Some function switches can be implemented on the wireless remote control (19) only due to physical space limitation on the control and driving unit (13). One can use another hand, voice or other means to activate the functions without disturbing the hand holding this hair cutting device (5).

Figure 6:
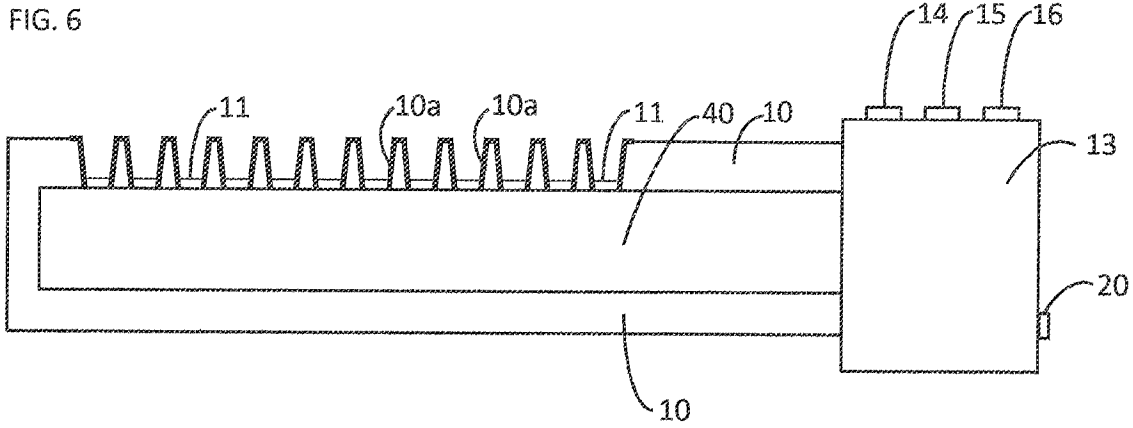
FIG. 6 is the front view showing a cover (40) covering the moving cutting arm (12).

In another embodiment, there is a moving cutting arm cover (40) as in FIG. 6 to protect the user from the motion of moving cutting arm (12). This cover (40) can be moved up and down by the control and driving unit (13) in a similar, yet separately controlled, fashion as the hair guard (11).

This moving cutting arm cover (40) in FIG. 6 can serve as another hair guard on the side of moving cutting arm (12), in addition to the hair guard (11). It is able to move up and down in unison with hair guard (11). The advantage of this embodiment will allow this hair cutting device be held and used by either right or left hand, without having the moving cutting arm (12) touching the head directly.

In yet another embodiment, the moving cutting arm (12) can be positioned between the comb like piece (10) and hair guard (11). So the hair guard (11) also serves as a cover for the moving and cutting arm (12). This embodiment also allows the hair cutting device be held and used by either right or left hand, without having the moving cutting arm (12) touching the head.

It is also possible that even the lower part of the comb like piece teeth can be smooth. A separate hair cutting mechanism can be formed by the moving cutting arm (12) and another set of sharp teeth, not shown in drawings, behind the lower parts of comb like piece teeth.

Figure 7:
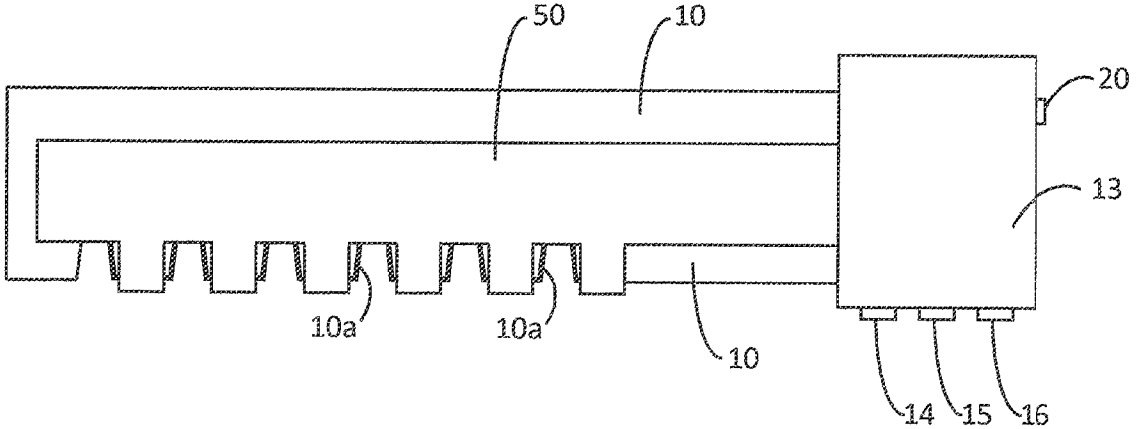
FIG. 7 is the top side down rear view showing a selective hair guard (50) in place of regular hair guard (11).

A selective hair guard (50) in FIG. 7 can be used by replacing the regular level hair guard (11) in FIG. 3. Selective hair guards allow different parts of the cutting teeth exposed when the selective hair guard (50) is lowered. FIG. 7 shows every other pair of cutting teeth is blocked by the selective hair guard (50) when it is lowered. Different selective hair guard patterns can be designed to allow different cuts.

When it is impractical to increase spacing too big between the hair guard and comb like piece, additional spacers can be attached to the hair guard to provide additional spacing between the head and cutting associated with comb like piece. Although such spacers are not shown in this disclosure, one with average skill in the art can easily come up with such design.

In yet another embodiment, there can be more entirely smooth comb like teeth on the comb like piece (10). Both the top and bottom parts of the teeth are smooth like comb teeth. These entirely smooth comb teeth can be located outside the range of the cutting teeth (12*a*) of the moving cutting arm, on either or both sides. In this manner, this comb like cutting device will have many comb teeth, but only some of them will cut hair when hair cutting functions are activated.

Figure 8:
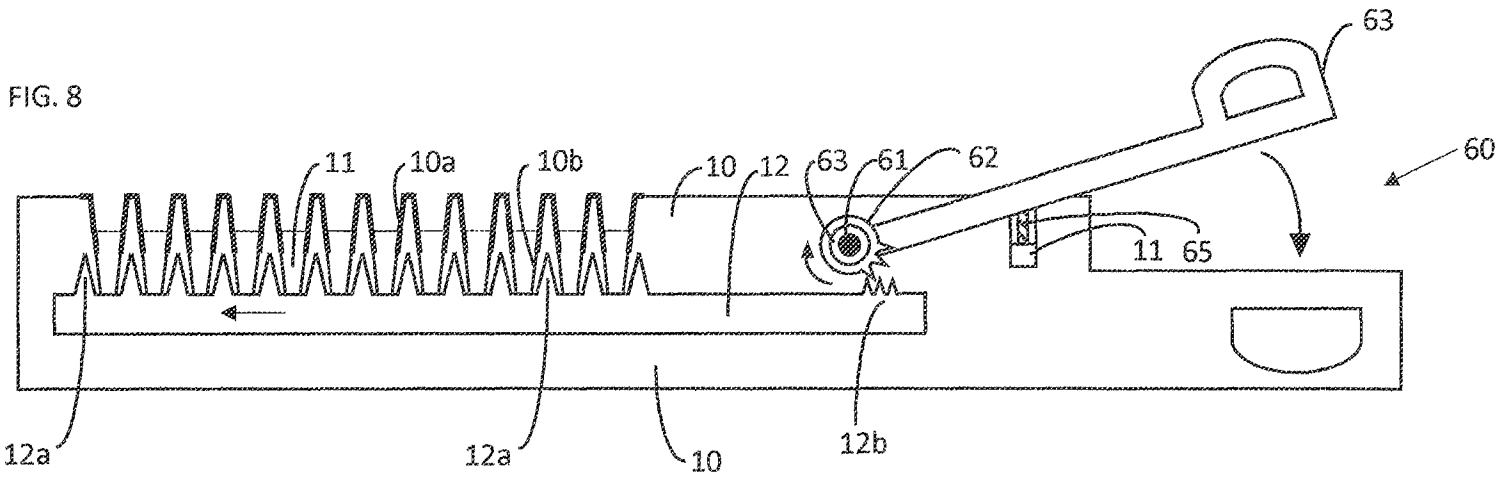
FIG. 8 shows the front view of a manual driven embodiment (60) of this haircutting device.
Figure 9:
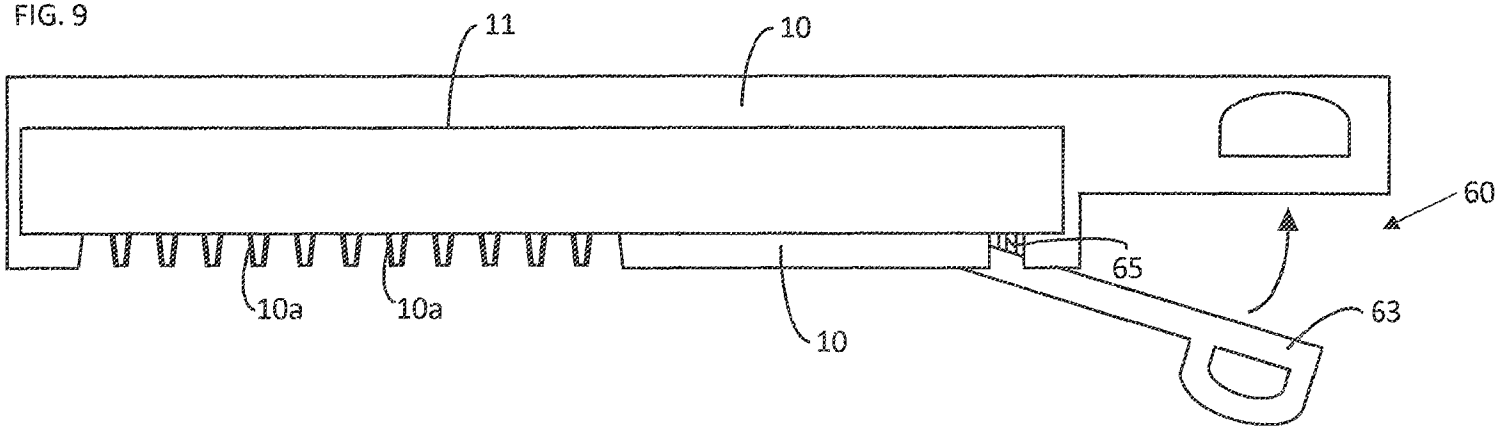
FIG. 9 shows the top side down rear view of the manual driven embodiment (60) of this haircutting device.

FIG. 8 and FIG. 9 show this hair cutting device can be implemented as a manual cutting device (60). The lowering of hair guard (11) and cutting motion of moving cutting arm (12) can be activated manually as shown in FIG. 8 and FIG. 9. A scissor like arm (63) with a tap (65) is coupled with a circular moving piece (62) with driving teeth. The comb like piece (10) also serves as the other arm of the scissor. The tap (65) protrudes out a little bit and is able to push down the hair guard (11). When this scissor like arm (63) closes, the tap (65) first pushes down the hair guard (11) exposing the cutting teeth of both comb like piece (10) and moving cutting arm (12). The scissor like arm (63) and circular moving piece (62) rotate around a pivot (61). The driving teeth on circular moving piece (62) then engage the driving teeth (12*b*) on moving cutting arm (12). The moving cutting arm (12) moves sideways as indicated. The cutting teeth (10*b*) of comb like piece (10) and (12*a*) of moving cutting arm (12) will cut off the hair between them. When the scissor like arm (63) opens, these associated motions reverse. Although it is not shown in the drawings, one with ordinary skill in mechanical design can return the hair guard (11) to its original position. Thus completes one cutting step. This process can be repeated until desired hair cut is achieved.

In another embodiment, the control and driving unit (13) or the manual mechanism of the manual cutting device (60) can be located at left side for left handed users, or directly below the comb like piece (10) like regular hair clipper.

Operations

Adjust the hair guard spacing (16 or 16R) for the desired hair length after the cut.

Use a mirror, mirrors or a camera with a display to see all sides of one's head. Comb the hair to expose the hair need to be cut off. Activate the single or short duration mode switch 14 (or 14R). Only the hair exposed by the comb like piece and between the sharp edges of comb like piece and moving cutting arm are cut. The single or short duration of cuts mode reduces the chance of accidentally cutting off unintended patches of hair, compared to a continuously running regular electric hair clipper. It behaves more like a pair of scissors or hair clipper guided by a comb, one cut at a time. The continuous cutting mode can be used as one's skill is improved, or at less critical patches of hair, or cutting someone else's hair. The horizontal orientation and comb like design make cutting one's own hair easy. Both cutting modes can be used interchangeably until the desired hair cut is achieved. Different attachments to the hair guard spacer or selective hair guards (50) can be used for the desired hair style This disclosure teaches a simple hair cutting device adapted for cutting one's own hair. The important ideas and various embodiments of this invention have been clearly demonstrated. Different variations can be made based on the ideas and various embodiments described above.

We claim the following:

1. A hair cutting device comprising:

a comb piece having a plurality of teeth with top portions of said the plurality of teeth toward open ends between said plurality of teeth being smooth and lower portions of said the plurality of teeth toward closed ends between said plurality of teeth having sharp edges;

a moving cutting arm with a plurality of sharp cutting teeth;

a hair guard adjacent to the comb piece positioned along a length of the comb piece; and a control unit coupled with said comb piece, said hair guard, and said moving cutting arm, the control unit having means for lowering and raising said hair guard relative to the sharp edges of the comb piece and driving said moving cutting arm sideways back and forth, wherein the control unit is capable of selectively:

moving the hair guard above the sharp edges of the lower portions of the plurality of teeth of the comb piece into a combing position thereby covering the sharp edges and enabling a combing function with the top portions of the plurality of teeth of the comb piece; and moving the hair guard below the sharp edges of the lower portions of the plurality of teeth of the comb piece into a cutting position thereby exposing the sharp edges and enabling a cutting function with the sharp edges, wherein when the hair guard is in the cutting position, the plurality of sharp cutting teeth of the moving cutting arm is configured to reciprocate back and forth to cut off hair in conjunction with the sharp edges of the lower portions of the plurality of teeth of the comb piece.

2. The hair cutting device of claim 1, further comprising:

an electric motor, a switch, and means for making decisions to perform hair cutting functions.

3. The hair cutting device of claim 1, further comprising:

a wireless receiver to receive wireless control signals.

4. The hair cutting device of claim 1, wherein the comb piece is coupled with a mechanically pivoted arm having means to push down and raise up said hair guard, said mechanical pivoted arm being further coupled with a circular moving piece having means to drive said moving cutting arm sideways back and forth.

5. A power hair cutting device comprising:

a comb piece having a plurality of teeth with top portions of said the plurality of teeth toward open ends between said plurality of teeth being smooth and lower portions of said the plurality of teeth toward closed ends between said plurality of teeth having sharp edges;

a moving cutting arm with a plurality of sharp cutting teeth;

a hair guard adjacent to the comb piece positioned along a length of the comb piece; and a control unit coupled with said comb piece, said hair guard, and said moving cutting arm, the control unit having means for lowering and raising said hair guard relative to the sharp edges of the comb piece and driving said moving cutting arm sideways back and forth, wherein the control unit is capable of selectively:

moving the hair guard above the sharp edges of the lower portions of the plurality of teeth of the comb piece into a combing position thereby covering the sharp edges and enabling a combing function with the top portions of the plurality of teeth of the comb piece; and moving the hair guard below the sharp edges of the lower portions of the plurality of teeth of the comb piece into a cutting position thereby exposing the sharp edges and enabling a cutting function with the sharp edges, wherein when the hair guard is in the cutting position, the plurality of sharp cutting teeth of the moving cutting arm is configured to reciprocate back and forth to cut off hair in conjunction with the sharp edges of the lower portions of the plurality of teeth of the comb piece; and a wireless remote control configured to control functions of the moving cutting arm.

* * * * *